US006376774B1

(12) United States Patent
Oh et al.

(10) Patent No.: US 6,376,774 B1
(45) Date of Patent: Apr. 23, 2002

(54) HOUSING FOR CABLE ASSEMBLY

(75) Inventors: Seibang Oh, Elk Grove Village; Carl S. Reid, Northbrook, both of IL (US)

(73) Assignee: Littelfuse Inc., DesPlaines, IL (US)

( * ) Notice: Subject to any disclaimer, the term of this patent is extended or adjusted under 35 U.S.C. 154(b) by 0 days.

(21) Appl. No.: 09/520,696

(22) Filed: Mar. 7, 2000

Related U.S. Application Data

(63) Continuation-in-part of application No. 09/234,012, filed on Jan. 19, 1999, now Pat. No. 6,046,665, which is a continuation-in-part of application No. 08/803,717, filed on Feb. 21, 1997, now abandoned, which is a continuation-in-part of application No. 08/697,337, filed on Aug. 22, 1996, now abandoned.

(51) Int. Cl.[7] ..... H07G 15/113
(52) U.S. Cl. ..... 174/92
(58) Field of Search ..... 174/92, 138 F

(56) References Cited

U.S. PATENT DOCUMENTS

| | | | | |
|---|---|---|---|---|
| 1,175,103 A | | 3/1916 | Williams | |
| 1,579,596 A | | 4/1926 | Cote | |
| 2,414,865 A | | 1/1947 | Genter | |
| 2,872,501 A | | 2/1959 | McMahon | |
| 3,422,213 A | | 1/1969 | Webb | |
| 3,519,731 A | * | 7/1970 | Grunbaum | 174/92 |
| 3,601,737 A | | 8/1971 | Baird et al. | |
| 3,766,307 A | | 10/1973 | Andrews, Jr. | |
| 3,766,509 A | | 10/1973 | Cameron | |
| 4,280,748 A | | 7/1981 | McHenney et al. | |
| 4,308,515 A | | 12/1981 | Rooney et al. | |
| 4,333,701 A | | 6/1982 | Schick | |
| 4,365,226 A | | 12/1982 | Barry et al. | |
| 4,391,485 A | | 7/1983 | Urani | |
| 4,612,680 A | * | 9/1986 | Daiguji | 174/92 X |
| 4,679,877 A | | 7/1987 | Ahroni | |
| 4,734,059 A | | 3/1988 | Melvgin | |
| 4,831,353 A | | 5/1989 | Gaia et al. | |
| 4,880,943 A | | 11/1989 | Kuzuno et al. | |
| 4,958,426 A | | 9/1990 | Endo et al. | |
| 5,018,991 A | | 5/1991 | Katz et al. | |
| 5,162,773 A | | 11/1992 | Shiozaki | |
| 5,241,134 A | | 8/1993 | Yoo | |
| 5,298,877 A | | 3/1994 | Gurevich et al. | |
| 5,304,740 A | | 4/1994 | Bozell et al. | |
| 5,329,065 A | | 7/1994 | Marney et al. | |
| 5,345,210 A | | 9/1994 | Swensen et al. | |
| 5,391,836 A | | 2/1995 | Bortas et al. | |
| 5,493,069 A | | 2/1996 | Conti | |
| 5,591,366 A | | 1/1997 | Schmidt et al. | |

OTHER PUBLICATIONS

*Hawley's Condensed Chemical Dictionary, 12$^{th}$ Edition, p. 1242.

* cited by examiner

*Primary Examiner*—Chan N. Nguyen
(74) *Attorney, Agent, or Firm*—Bell, Boyd & Lloyd LLC

(57) ABSTRACT

A housing for an electrical overload protection cable assembly having a first cable, a second cable, a fusible link, and a protective housing. The protective housing has a first housing member and a second housing member. The first and second housing members each have a first end portion and a second end portion. The first and second housing members are coupled to form the protective housing having a channel extending from the first end to the second end. A first rib extends from the protective housing into the channel, and a second rib extends from the protective housing into the channel. The second rib is transverse to the first rib.

15 Claims, 2 Drawing Sheets

HOUSING FOR CABLE ASSEMBLY

RELATED APPLICATIONS

This application is a continuation-in-part of U.S. patent application Ser. No. 09/234,012 filed Jan. 19, 1999, now U.S. Pat. No. 6,046,665, which is a continuation-in-part of U.S. patent application Ser. No. 08/803,717 filed Feb. 1997, now abandoned, which is a continuation-in-part of U.S. patent application Ser. No. 08/697,337 filed Aug. 22, 1996, now abandoned. U.S. patent application Ser. Nos. 09/234,012, 08/697,337 and 08/803,717 are hereby incorporated herein by reference, and made a part hereof.

TECHNICAL FIELD

The invention relates to the field of electrical protection, and is particularly directed to a housing for protecting electrical devices and for protectively coupling two cables and a fissile link.

BACKGROUND OF THE INVENTION

Automobiles are increasingly reliant on electronic controls and engine management systems. As a result of these controls and systems, modern automobiles are much more dependable than prior autos, which instead used more vulnerable mechanical systems. Although the hardware embodying the electronic controls and systems is rather dependable, the failure of the means for directly or indirectly bringing electrical current to such hardware continues to be a rare but, nevertheless, significant source of automotive breakdowns. An automotive breakdown, especially in a deserted area or on a very busy high-speed road, is obviously a safety hazard to the automobile and its passengers.

One specific type of failure in prior art means can lead to an even more hazardous condition than automotive breakdown. This failure occurs at the junction between the fusible link and the current-carrying cable, causing high resistance and increased temperatures. Under certain conditions the increased temperatures can reach sufficiently high levels to split the insulation on the conventional copper-wire fusible links, initiating an engine compartment fire that can quickly destroy the automobile and endanger its occupants.

U.S. Pat. No. 5,591,366 issued to Schmidt et al. discloses a series of protective coverings over a heating wire connected to a power wire. The heating wire is connected in series to an electrical pin which is directly joined to a fuse wire. The fuse wire is then joined to the power wire. Two opposing metal caps are bonded on their inner surfaces to a ceramic tube to form a hermetically sealed shell surrounding the junctions between the fuse wire and pin, and between the fuse wire and power wire. Then, a heat shrinkable tubing is used to grip the caps and ceramic tubing, encasing the fuse area.

Like other prior art devices, the disclosure of U.S. Pat. No. 5,591,366 does not solve the problem of protecting failure at the junctions of the fusible link due to force applied to the cable assembly.

In addition to the excess heat generated due to failures at the junctions of the fusible link and the cable, excess heat is often generated by the fusible link itself causing a failure of the insulative housing as well.

The insulating cover cannot withstand extreme temperatures and, under certain excessive current conditions, will melt, split, burn or separate from the wire long before the copper wire link melts. Additionally, as current passes through the wire it heats up causing the insulating cover to shrink. When the insulating wire shrinks it pulls away from the protective housing connected thereto, increasing the likelihood of failure of the cable assembly.

Accordingly, a housing for a cable assembly in accordance with the present invention eliminates the drawbacks of the prior art devices described above.

SUMMARY OF THE INVENTION

According to one aspect of the present invention, a protective housing is provided for a fusible link and cable assembly. The protective housing includes a first housing member having a first end portion and a second end portion, and a second housing member having a first end portion and a second end portion. The first and second housing members are coupled to form the protective housing. When the first and second housing members are coupled together, a channel extends from the first end thereof to the second end thereof. Additionally, a first rib extends from the protective housing into the channel, and a second rib extends from the protective housing into the channel. The second rib is generally transverse to the first rib.

According to another aspect of the present invention a first rib and a second rib extend from the first housing member into the channel. The second rib of the first housing member is transverse to the first rib of the first housing member. Similarly, a first rib and a second rib extend from the second housing member into the channel. The second rib of the second housing member is transverse to the first rib of the second housing member.

According to another aspect of the present invention, the first rib extending from the protective housing member extends axially from the protective housing, and the second rib extending from the protective housing extends substantially perpendicular to the first rib.

According to another aspect of the present invention, a shoulder extends from the first housing member, and the second housing member has a groove therein. Generally, the shoulder in the first housing member extends adjacent a side of the first housing member, and the groove in the second housing member extends adjacent a side of the second housing member. The shoulder of the first housing member mates with the groove of the second housing member when the first and second housing members are coupled. Additionally, the first housing member may also have a groove therein in addition to the shoulder, and the second housing member may also have a shoulder extending therefrom in addition to the groove. The shoulder of the second housing member is adapted to mate with the groove of the first housing member when the first and second housing members are coupled.

According to another aspect of the present invention, the first housing member is fixedly connected to the second housing member.

According to another aspect of the present invention, the protective housing comprises a pair of housing members, each housing member having a first end portion, a second end portion, and an intermediate section therebetween. The first end portion has a first cavity, the second end portion has a second cavity, and the intermediate section has an intermediate cavity. The intermediate cavity has a greater volume than the first and second cavities. A first rib protrudes from each housing member into the first cavity and a transverse second rib protrudes from each housing member into the second cavity. Additionally, each housing member has a groove adjacent a side thereof and a shoulder adjacent an opposing side thereof. The housing members connectedly mate to form the protective housing, and the first, second, and intermediate cavities of the housing members form a channel from the first end of the protective housing to the second end of the protective housing.

According to another aspect of the present invention a protective housing covers the fusible link and portions of the first and second cables. The first and second ribs contact the protective covering of the cables to contain the first and second cables.

According to yet another aspect of the present invention, the first and second housing members have interconnecting members to mate the first and second housing members together.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION OF THE PREFERRED EMBODIMENT

Figure 1:
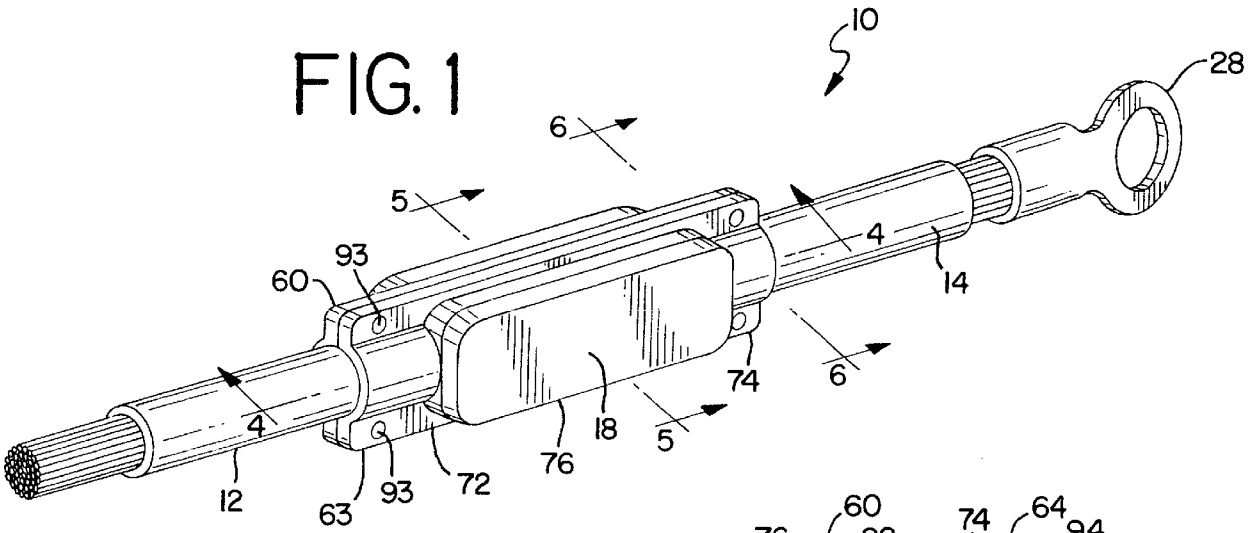
FIG. 1 is a perspective view of the protective housing for fusible link and cable assembly of the present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 2:
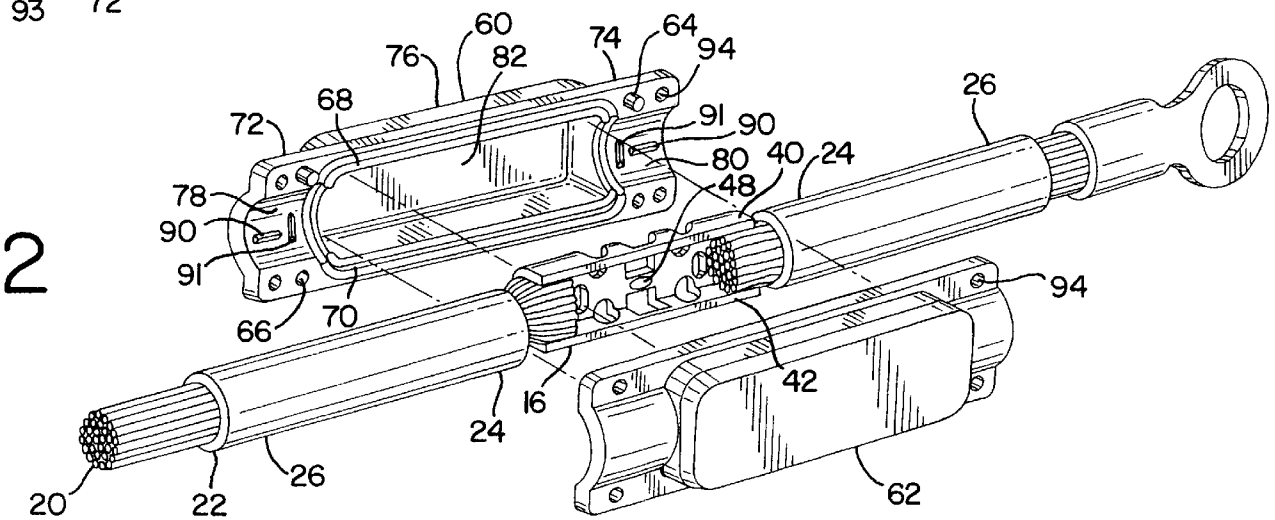
FIG. 2 is an exploded perspective view of the assembly of FIG. 1.
Figure 3:
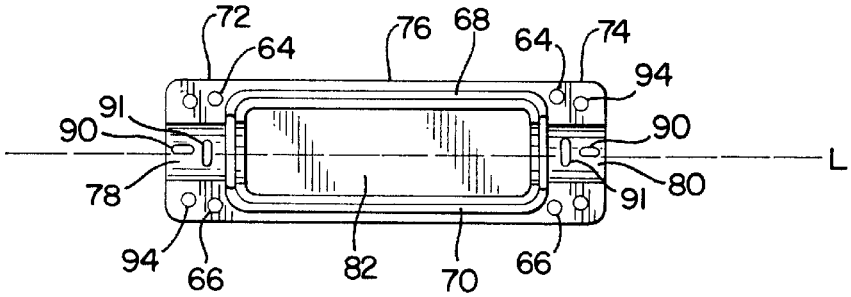
FIG. 3 is a top plan view of one of the protective housing members shown in FIG. 1.

Referring now in detail to the Figures, and initially to FIGS. 1–3, there is shown a preferred embodiment of the present invention. FIGS. 1 and 2 show an improved cable assembly 10 including a first cable 12, a second cable 14, a fusible link 16, and a protective housing 18. The present invention is an improvement over the prior art cable and fusible link combination in that the protective housing 18 securably engages the first and second cables 12,14, to prevent both axial and rotational movement of the cables 12,14. As such, a much more rigid assembly is provided to prevent loosening or breaking of the connection between the first and second cables 12,14 or wires and the fusible link 16. Additionally, features of the housing 18 provide for increased protection for the components within the housing 18 from outside elements. Thus, the present embodiment offers stability and safety features previously not available with prior housings for fusible link and cable assemblies.

The first and second cables 12,14 are conventional insulated electrical cables and are generally comprised of a core of a plurality of elongated strands of wires 20 surrounded by a protective insulation layer 22, such as polyethylene. Nonetheless, a solid wire or cable could be employed as the core for the present invention in lieu of a stranded cable. The cable core 20 is made of a first material, preferably a conductive metal, and more preferably copper. Each of the cables 12,14 generally have a first or proximal end 24, and a second or distal end 26. A portion of the protective covering 22 or insulation adjacent the first or proximal end 24 of each cable is removed or stripped away from the cable. Preferably, approximately a ½" portion of insulating covering 22 is removed from the first end 24 of the cable. Thus, the end portion of the cables or wires extends past their respective protective coverings 22.

In one embodiment of the present invention the first cable 12 is made of 6 gauge wire. The first cable 12 may have a terminal 28 at the second or distal end 26 of the cable for connecting the cable to a power source (not shown). The second cable 14 is similarly made of a 6 gauge wire. The second cable 14 may have a terminal 28 at the second or distal end 26 of the cable for connecting to a desired electrical device (not shown) such as the starter of an automobile. Even though a 6 gauge wire is utilized in the embodiment illustrated, much larger and much smaller gauge wires, for example, from 10 gauge up to at least 2 gauge or larger, may be used as either the first cable, the second cable, or both the first and second cables. Furthermore, it is understood that the gauge thickness of the first cable could be different from the gauge thickness of the second cable.

Figure 4:
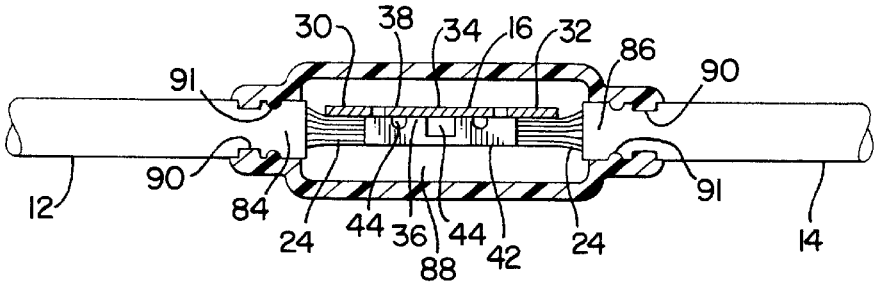
FIG. 4 is a cross-sectional view taken along line 4—4 of FIG. 1.
Figure 5:
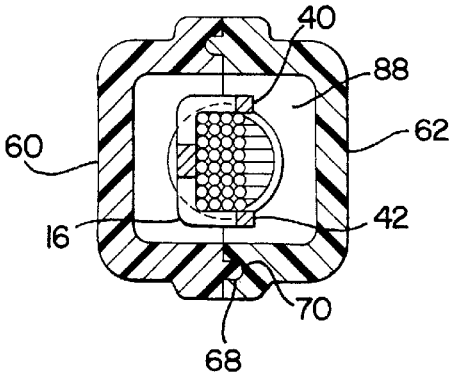
FIG. 5 is a cross-sectional view taken along line 5—5 of FIG. 1; and, FIG. 6 is a cross-sectional view taken along line 6—6 of FIG. 1.
Figure 6:
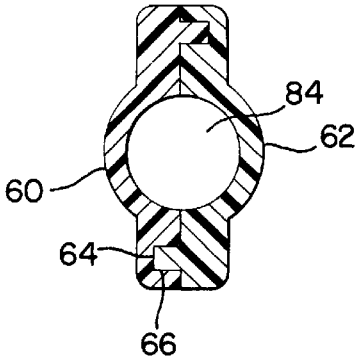

The fusible link of the preferred embodiment is illustrated in FIG. 4. The fusible link 16 is generally a 0.032 inch thick piece of conductive material, preferably copper or a copper alloy. The fusible link 16 is manufactured by conventional stamping and bending techniques. The fusible link 16 comprises opposing first and second ends 30,32 with an intermediate portion 34 therebetween, an upper surface 36, a lower surface 38, and opposing first and second transverse sides 40,42. Accordingly, the fusible link 16 is approximately U-shaped. The transverse sides 40,42 of the fusible link 16 provide superior bending strength and rigidity for the fusible link 16. In the preferred embodiment, the intermediate portion 34 of the fusible link 16 has a plurality of cutouts 44 therein. The cutouts 44 create regions of high electrical resistance. Additionally, a second conductive material 48 may be distributed on the fusible link 16 to lower the melting temperature of the fusible link. Preferably a tin or tin/lead spot 48 is distributed on the upper surface 36 of the fusible link 16 for such purposes.

Notwithstanding the above, the fusible link 16 can be made of any suitable conductive metal which can form a fuse element that, when properly configured, melts to open the circuit under both short circuit conditions and under prolonged modest overload conditions.

The first end portion 24 of each of the first and second cables 12,14 is electrically connected to the fusible link 16 adjacent the opposing first and second ends 30,32 of the fusible link, respectively. The first end portion 24 of the first cable 12 is electrically connected to the fusible link 16 adjacent the first end 30 of the fusible link, thereby creating a first connection point. Similarly, the first end portion 24 of the second cable 14 is electrically connected to the fusible link 16 adjacent the second end 32 of the fusible link, thereby creating a second connection point. As such, the fusible link 16 is located between and electrically connects the first and second cables 12,14. The means for electrically connecting the cables 12,14 to the fusible link 16 is preferably accomplished by brazing the cable to the fusible link. Other means, including compressing, welding, soldering and sonic welding, can be employed as well. As shown in FIGS. 2 and 4, the first cable 12 and the second cable 14 are preferably connected to the top surface of the fusible link 16, and between the transverse sides 40,42 thereof.

As shown in FIGS. 2–6, the protective housing 18 comprises a pair of housing members. Preferably, the pair includes a first housing member 60 and a second housing member 62. Each housing member 60,62 is generally made of a heat resistant plastic material. The protective housing 18 itself, as well as the first and second housing members 60,62 of the protective housing, each have a first end portion 72, a second end portion 74, and an intermediate section 76 therebetween. The first end portion 72 of each housing member has a first cavity 78, the second end portion 74 of each housing member has a second cavity 80, and the intermediate section 76 of each housing member has an intermediate cavity 82. The intermediate cavity 82 of the first and second housing members has a greater volume than that of the first and second cavities 78,80 of the first and second housing members.

Additionally, the first and second housing members 60,62 each have a shoulder 68 and groove 70 as shown in FIGS. 2 and 3. One shoulder 68 is adjacent a side of each of the first and second housing members 60,62. Similarly, one groove 70 is adjacent the opposing side of each of the first and second housing members 60,62. The shoulder 68 that extends from the first housing member 60 mates with the groove 70 in the second housing member 62 when the first and second housing members 60,62 are coupled, and the shoulder 68 that extends from the second housing member 62 mates with the groove 70 in the first housing member 60 when the first and second housing members 60,62 are coupled. The grooves 70 and shoulders 68 not only operate as a locating means for the first and second housing members during coupling thereof, but the mated shoulders 68 and grooves 70 also provide a seal area about the sides of the protective housing 18.

The first and second housing members 60,62 also have interconnecting members 64,66 which mate to assist in locating the first and second housing members 60,62 together for coupling thereof. The interconnecting members comprise a post 64 and a mating aperture 66. Each housing member 60,62 has a post 64 at the first and second end portions 72,74 of each respective housing member 60,62. The posts are adjacent one of the sides of the respective housing member 60,62. Additionally, each housing member 60,62 has an aperture 66 at the first and second end portions 72,74 of each respective housing member 60,62. The apertures 66 are adjacent the opposing side of the respective housing member 60,62 as that of the posts 64. Accordingly, the post 64 at the first end portion 72 of the first housing member 60 mates with the aperture 66 at the first end portion 72 of the second housing member 62, the post 64 at the second end portion 74 of the first housing member 60 mates with the aperture 66 at the second end portion 74 of the second housing member 62, the post 64 at the first end portion 72 of the second housing member 62 mates with the aperture 66 at the first end portion 72 of the first housing member 60, and the post 64 at the second end portion 74 of the second housing member 62 mates with the aperture 66 at the second end portion 74 of the first housing member 60. When coupled, the protective housing 18 covers the fusible link 16 and portions of the first and second cables 12,14.

As shown in FIG. 4, when the first and second housing members 60,62 are coupled together to form the overall protective housing 18, the protective housing 18 can be said to have a first channel portion 84 at a first end 72 thereof which houses a portion of the first cable 12; a second channel portion 86 at the second end 74 thereof which houses a portion of the second cable 14; and, an intermediate channel portion 88 between and connecting the first channel 84 and the second channel 86 which houses the fusible link 16. The first channel portion 84 is comprised of the first cavity 78 of the first and second housing members 60,62, the second channel portion 86 is comprised of the second cavity 80 of the first and second housing members 60,62, and the intermediate channel portion 88 of the protective housing 18 is comprised of the intermediate cavities 82 of the first and second housing members 60,62. The individual channel portions 84,86,88 cooperate to form a continuous channel extending from the first end 72 of the protective housing 18 to the second end 74 of the protective housing 18. The intermediate channel 88 houses the fusible link 16. A portion of the intermediate channel 88 is spaced a distance away from the fusible link 16 to create a gap between the fusible link 16 and an interior wall of the intermediate channel 88.

In the preferred embodiment the first housing member 60 and the second housing member 62 are identical components. Even though the protective housing 18 has been described as having a first housing member 60 and a second housing member 62, the protective housing 18 can be comprised of either two first housing members 60, or two second housing members 62, that is a pair of housing members. To mate the housing members, one housing member is rotated 180 degrees to allow the mating grooves/shoulders and posts/apertures to correspond.

The protective housing 18 further has a plurality of ribs 90,91 extending into the channel. As shown in FIG. 4, in the preferred embodiment, two first ribs 90 and two second ribs 91 extend from the protective housing 18 and into the channel at the first end portion 72 of the protective housing 18, and two first ribs 90 and two second ribs 91 extend from the protective housing 18 and into the channel at the second end portion 74 of the protective housing. More specifically, in the preferred embodiment a first rib 90 extends from the first housing member 60, at both the first and second end portions 72,74 thereof, and into the channel; and, a second rib 91 extends from the first housing member 60, at both the first and second end portions 72,74 thereof, and into the channel. Similarly, a first rib 90 extends from the second housing member 62, at both the first and second end portions 72,74 thereof, and into the channel; and, a second rib 91 extends from the second housing member 60, at both the first and second end portions 72,74 thereof, and into the channel.

As shown in FIGS. 2–4, the first and second housing members 60,62 have a longitudinal axis (L) which generally extends from the first end 72 of the respective housing member to the second end 74 of the respective housing member. The first ribs 90 of the first and second housing members 60,62 generally extend about a portion of the longitudinal axis (L) of the respective housing member 60,62. Accordingly, when the first and second housing members 60,62 are coupled to form the protective housing 18, the first ribs 90 extend axially from the protective housing 18. The second ribs 91 are transverse to the first ribs 90, and conversely, the first ribs 90 are transverse to the second ribs 91. In the preferred embodiment illustrated in FIG. 4, the second ribs 91 extend substantially perpendicular to the first ribs 90. As is explained later, however, the second ribs 91 do not have to be at exact right angles to the first ribs 90.

The first and second ribs 90,91 at the first end portion 72 of the first and second housing members 60,62 contact the protective covering 22 of the first cable 12 to grip and contain the first cable 12 at the first end portion 72, and the first and second ribs 90,91 at the second end portion 74 of the first and second housing members 60,62 contact the protective covering 22 of the second cable 14 to grip and contain the second cable. Generally, the ribs 90,91 comprise a protrusion extending from the housing member. In the preferred embodiment, the ribs 90,91 have an apex for securely engaging the cable. Further, in the preferred embodiment the ribs 90,91 at the first end portion 72 extend from an interior wall of the first channel and the ribs 90,91 at the second end portion 74 extend from an interior wall of the second channel. When the two housing members 60,62 of the protective housing 18 are mated and firmly connected together, portions of the ribs 90,91 are indented into the insulative layer 22 of the cable. This allows the engaging ribs 90,91 to securely grip and contain the cable 12,14 such that the cable is not capable of movement with respect to the protective housing 18. Specifically, the first ribs 90 which extend about a portion of the longitudinal axis (L) of the protective housing 18 prevent rotational movement of the cables 12,14 with respect to the protective housing 18. And, the second ribs 91 which extend transversely to the first ribs 90 prevent axial movement of the cables (i.e., movement of the cables into and out of the protective housing). By having ribs that are transverse to other ribs, whether the transverse ribs are perpendicular to the axial ribs or not, any type of movement of the cable with respect to the protective housing is substantially eliminated. Preventing movement of the cable with respect to the protective housing ensures that the cable assembly will not fail at the connection points of the cables and the fusible links. As such, the first cable 12, the protective housing 18, the fusible link 16, and the second cable 14 form a unitary element when the protective housing 18 is secured around the cable assembly.

The inside diameter of the first and second cavities 78,80, and thus of the formed channels 84,86 can be varied to accommodate different size cables. Additionally, the height of the ribs 90,91 may vary accordingly with the variation in the cavity diameter. For a 6 gauge cable the cavity diameter is approximately 0.266" and the height of the ribs are 0.032". For an 8 gauge cable the cavity diameter is approximately 0.182" and the height of the ribs are 0.032". For a 4 gauge cable the cavity diameter is approximately 0.310" and the height of the ribs are 0.032". Even though the cavity diameter and rib height can be varied, a small change in the size of the cable does not necessarily require a change in the cavity diameter of the housing. The parameters of the cavity 84,86 and ribs 90,91 are such that a certain size cavity can accommodate small increases and decreases in the diameter of the cable 12,14.

Once the first and second housing members 60,62 are mated around and over the fusible link 16 and portions of the first and second cables 12,14, the first and second housing members 60,62 are fixedly connected with rivets 93 which extend through apertures 94 in the housing members 60,62. In the preferred embodiment apertures 94 for rivet 93 are located adjacent each of the four comers of the protective housing 18. It should be known however, that the first and second housing members 60,62 could be fixedly connected by any other means, including adhesives, welding, or any other connecting means. By fixedly connecting the first and second housing members 60,62 together, the ribs 90,91 are maintained securely in the protective covering 22 of the cables 12,14 to maintain the cables in place. As such, the cable 12,14 and fusible link 16 are securely connected to the housing 18.

While the specific embodiments have been illustrated and described, numerous modifications come to mind without significantly departing from the spirit of the invention, and the scope of protection is only limited by the scope of the accompanying claims.

We claim:

1. A protective housing for a fusible link and cable assembly comprising:

a first housing member having a first end portion and a second end portion, a second housing member having a first end portion and a second end portion, the first and second housing members coupled to form the protective housing having a channel extending from the first end portion to the second end portion thereof, wherein first and second ribs extend from the first end portion of one of either the first housing member or the second housing member, the second rib being transverse to the first rib, and wherein first and second ribs extend from the second end portion of the other of either the first housing member or the second housing member, the second rib being transverse to the first rib.

2. The housing of claim 1, further comprising a shoulder extending from the first housing member, and a groove in the second housing member, the shoulder of the first housing member mating with the groove of the second housing member when the first and second housing members are coupled.

3. The housing of claim 2, further comprising a groove in the first housing member, and a shoulder extending from the second housing member, the shoulder of the second housing member mating with the groove of the first housing member when the first and second housing members are coupled.

4. The housing of claim 1, wherein each of the first ribs extend axially from the protective housing, and wherein each of the second ribs extend substantially perpendicular to the first ribs.

5. A protective housing for a fusible link and cable assembly comprising:

a first housing member having a first end portion and a second end portion, and a shoulder extending from the first housing member;

a second housing member having a first end portion and a second end portion, the second housing member having a groove therein;

wherein the shoulder of the first housing member mates with the groove in the second housing member when the first and second housing members are connected to form the protective housing, wherein a channel is formed in the protective housing between the first and second housing members, wherein the first housing member has first and second ribs extending from the first end portion of the first housing member into the channel, the first rib of the first housing member being transverse to the second rib of the first housing member, and wherein the second housing member has first and second ribs extending from the second end portion of the second housing member into the channel, the first rib of the second housing member being transverse to the second rib of the second housing member.

6. The protective housing of claim 5, further comprising first and second ribs extending from the first end portion and the second end portion of the first housing member into the channel, the first rib extending from the second end portion of the first housing member being transverse to the second rib extending from the second end portion of the first housing member; and, first and second ribs extending from the first end portion and the second end portion of the second housing member into the channel, the first rib extending from the second end portion of the second housing member being transverse to the second rib extending from the second end portion of the second housing member.

7. The protective housing of claim 5, further comprising a shoulder extending from the second housing member, and a groove in the first housing member, wherein the shoulder and groove of the first housing member mate with the groove and shoulder, respectively, of the second housing member when the first and second housing members are connected.

8. The protective housing of claim 5, wherein the shoulder extends adjacent a side of the first housing member, and wherein the groove extends adjacent a side of the second housing member.

9. The protective housing of claim 5, wherein the first housing member is an identical component as the second housing member.

10. The protective housing of claim 5, wherein the first housing member is fixedly connected to the second housing member.

11. A protective housing for a fusible link and cable assembly comprising:

a pair of housing members, each housing member having a first end portion, a second end portion, and an intermediate section therebetween, the first end portion having a first cavity, the second end portion having a second cavity, and the intermediate section having an intermediate cavity, wherein the intermediate cavity has a greater volume than the first and second cavities, wherein a first rib protrudes from each housing member into the first cavity, wherein a second rib protrudes from each housing member into the second cavity, the first rib being transverse to the second rib, wherein each housing member has a groove adjacent a side thereof and a shoulder adjacent an opposing side thereof, and wherein the housing members connectedly mate to form the protective housing, the first, second, and intermediate cavities of the housing members forming a channel from a first end of the protective housing to a second end of the protective housing.

12. The protective housing of claim 11, wherein the protective housing has a longitudinal axis extending from the first end of the protective housing to the second end of the protective housing, the first rib of the each housing member extending about portion of the longitudinal axis of the protective housing.

13. The protective housing of claim 12, wherein the second rib of each housing member, respectively, extends substantially perpendicular to the first rib.

14. The protective housing of claim 11, wherein the housing members are fixedly connected to each other.

15. A protective housing for a fusible link and cable assembly comprising:

a housing member having a first end portion, a second end portion, and a channel extending from the first end portion to the second end portion thereof, wherein a plurality of first ribs extend from the housing member about a portion of a longitudinal axis of the housing member, at least one of the first ribs extending adjacent the first end portion of the housing member and at least another one of the first ribs extending adjacent the second end of the housing member, the longitudinal axis of the housing member extending from the first end of the housing member to the second end of the housing member, and wherein a plurality of second ribs extend from the housing member, the second ribs being transverse to the first ribs.

* * * * *